US007301424B2

(12) United States Patent
Suarez-Gartner et al.

(10) Patent No.: US 7,301,424 B2
(45) Date of Patent: Nov. 27, 2007

(54) FLEXIBLE WAVEGUIDE CABLE WITH A DIELECTRIC CORE

(75) Inventors: Ricardo Suarez-Gartner, Hillsboro, OR (US); Stephen Hall, Hillsboro, OR (US); Bryce Horine, Aloha, OR (US); Anusha Moonshiram, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/170,426

(22) Filed: Jun. 29, 2005

(65) Prior Publication Data

US 2007/0001789 A1 Jan. 4, 2007

(51) Int. Cl.
*H01P 3/14* (2006.01)

(52) U.S. Cl. ..... 333/239; 333/248

(58) Field of Classification Search ..... 333/1, 333/239, 248

See application file for complete search history.

(56) References Cited

U.S. PATENT DOCUMENTS 2,436,421 A * 2/1948 Cork ..... 138/125
2,761,137 A * 8/1956 Van Atta et al. ..... 343/771
3,066,268 A 11/1962 Karbowiak
3,577,105 A * 5/1971 Jones, Jr. ..... 333/239
4,647,882 A * 3/1987 Landis ..... 333/239
4,785,268 A 11/1988 Walter et al.
4,875,026 A * 10/1989 Walter et al. ..... 333/251
5,528,208 A 6/1996 Kobayashi
5,805,030 A * 9/1998 Dhuey et al. ..... 333/1
6,590,477 B1 * 7/2003 Elco ..... 333/239
6,885,549 B2 * 4/2005 Thomason ..... 361/683

FOREIGN PATENT DOCUMENTS

CA 2 449 596 A1 6/2005
DE 3 244 746 A1 6/1984
FR 2 088 390 A 1/1972
FR 2 433 838 A1 3/1980
GB 2 387 544 A 10/2003

OTHER PUBLICATIONS

"PCT International Search Report of the International Searching Authority", mailed Nov. 3, 2006, for PCT/US2006/025776, 4pgs.

* cited by examiner

*Primary Examiner*—Benny T. Lee
(74) *Attorney, Agent, or Firm*—Buckley, Maschoff & Talwalkar LLC

(57) ABSTRACT

According to some embodiments, a waveguide cable includes a dielectric core and a conducting layer surrounding the dielectric core. A first antenna may be provided at a first end of the waveguide cable to receive a digital signal and to propagate an electromagnetic wave through the dielectric core. A second antenna may be provided at a second end of the waveguide cable, opposite the first end, to receive the electromagnetic wave from the dielectric core and to provide the digital signal.

10 Claims, 9 Drawing Sheets

FLEXIBLE WAVEGUIDE CABLE WITH A DIELECTRIC CORE

BACKGROUND

Computers and other electronic devices may exchange digital information through a cable. For example, a Personal Computer (PC) might transmit data to another PC or to a peripheral (e.g., a printer) through a coaxial or Category 5 (Cat5) cable. Moreover, the rate at which computers and other electronic devices are able to transmit and/or receive digital information is increasing. As a result, it may be desirable to provide a cable that can transfer information at relatively high data rates, such as 30 Gigahertz (GHz) or higher.

DETAILED DESCRIPTION OF PREFERRED EMBODIMENTS

Figure 1:
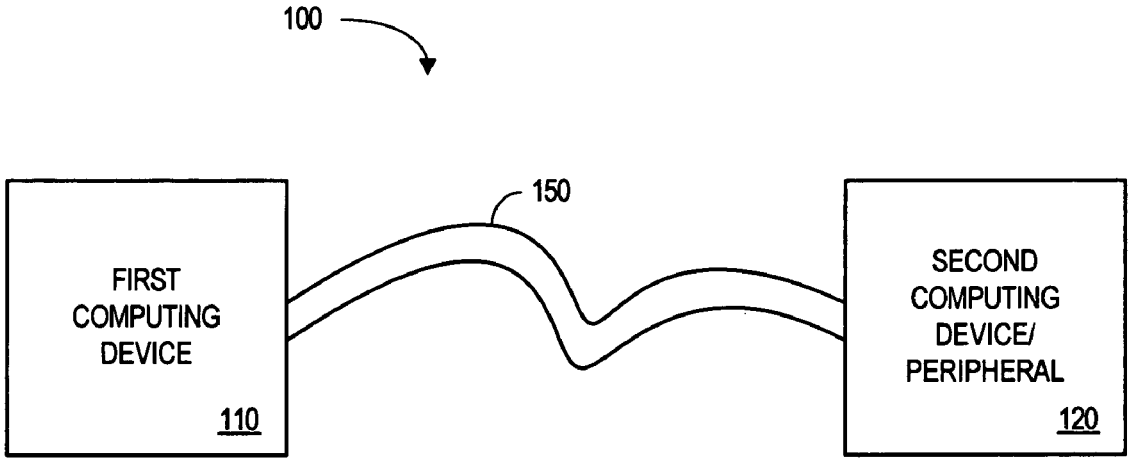
FIG. 1 is a block diagram of a system according to some embodiments.

Computers and other electronic devices may exchange digital information through a cable. For example, FIG. 1 is a block diagram of a system 100 in which a first computing device 110 and a second computing device 120 exchange information via a cable 150. The computing devices 110, 120 might be associated with, for example, a PC, a mobile computer, a server, a computer peripheral (e.g., a printer or display monitor), a storage device (e.g., an external hard disk drive or memory unit), a display device (e.g., a digital television, digital video recorder, or set-top box), or a game device.

SUMMARY OF THE INVENTION

According to some embodiments, an apparatus may be provided including a cable portion, including with (i) a dielectric core extending the length of the cable portion, and (ii) a conducting layer extending the length of the cable portion and surrounding the dielectric core. A first antenna, at a first end of the cable portion, may be provided to receive a digital signal and to propagate an electromagnetic wave through the dielectric core. A second antenna, at a second end of the cable portion opposite the first end, maybe provided to receive the electromagnetic wave from the dielectric core and to provide the digital signal.

The cable 150 might comprise, for example, a coaxial, Unshielded Twisted-Pair (UTP), Shielded Twisted-Pair cabling (STP), or Cat5 cable adapted to electrically propagate digital information.

Figure 2:
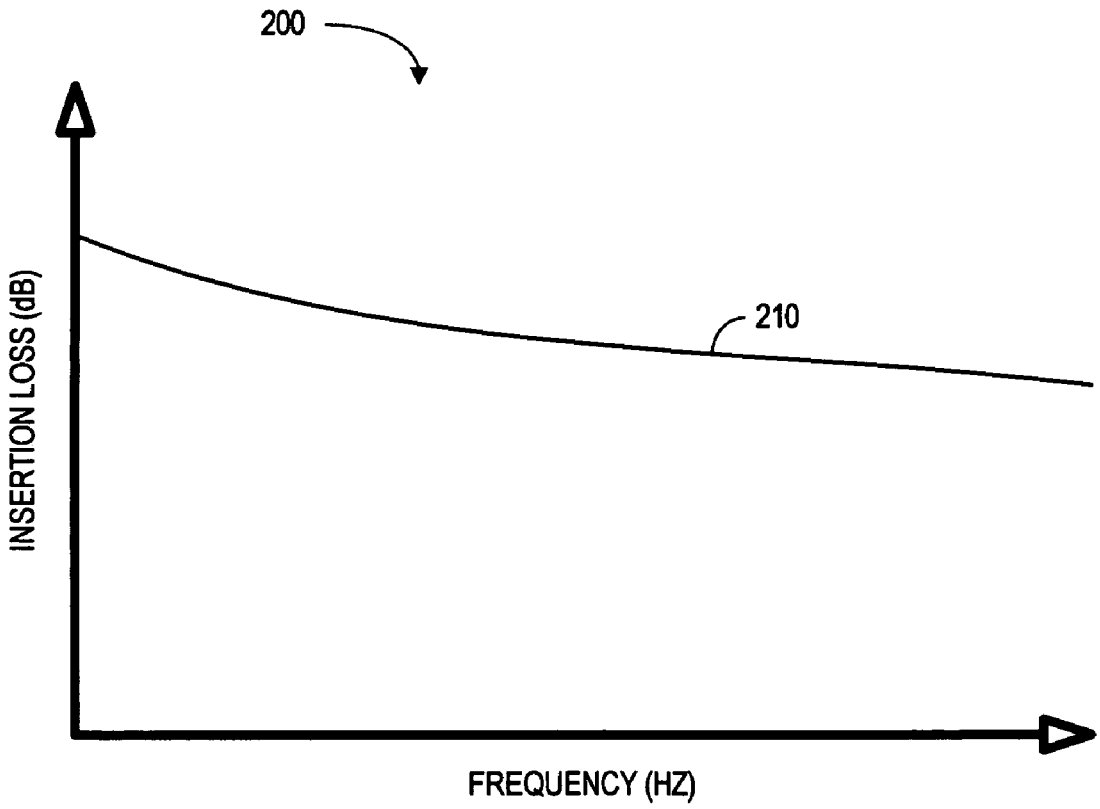
FIG. 2 is a chart illustrating insertion loss as a function of frequency.

As the rate at which digital information is being transmitted increases, energy losses associated with the cable 150 may also increase. For example, FIG. 2 is a chart 200 illustrating insertion loss for a typical electrical cable as a function of frequency. An x-axis represents the frequency at which digital information is transmitted in Hertz (Hz) (with movement along the x-axis to the right representing an increase in the rate), and a y-axis represents the associated insertion loss in decibels (dB) (with movement along the y-axis upwards representing an decrease in the loss, and therefore an increase in the strength of the signal). As can be seen by plot 210, increasing the rate at which digital information is transmitted will cause the insertion loss to increase (and therefore the signal strength will decrease). Moreover, the frequency response of a typical cable might cause significant Inter-Symbol Interference (ISI) at relatively high frequencies.

As a result, the rate at which digital information can be transmitted through a typical electrical cable may be limited. Consider, for example, a ten foot electrical cable. In this case, signal losses may make it impractical to transmit digital signals at 30 GHz or higher.

To avoid such a limitation, the cable 150 may be formed as a fiber optic cable adapted to optically transmit digital information. Such an approach, however, may require a laser or other device to convert an electrical signal at the first computing device 110 (and a light detecting device at the second computing device 120 to convert the light information back into electrical signals). These types of non-silicon components can be expensive, difficult to design, and relatively sensitive to system noise.

Figure 3:
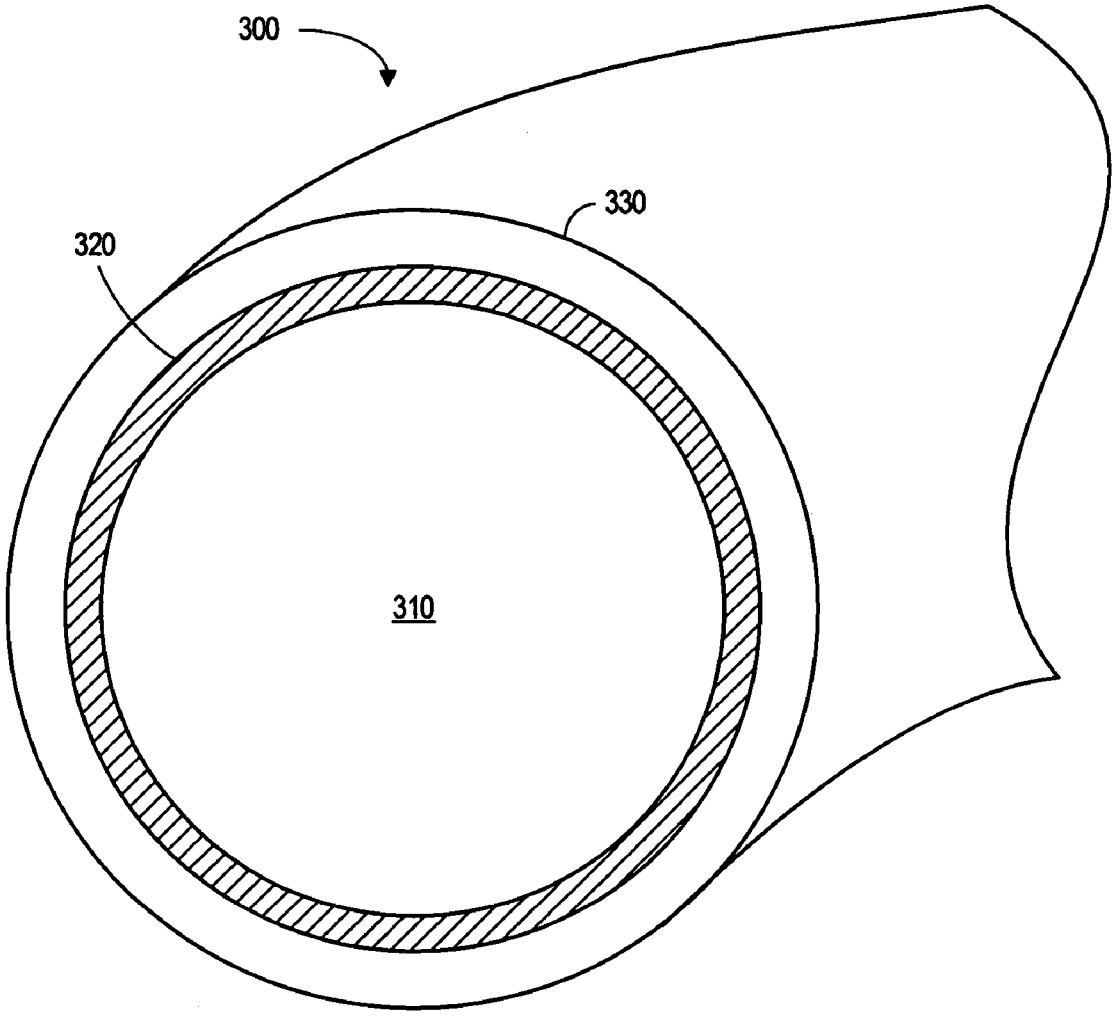
FIG. 3 is cross-sectional view of a waveguide cable according to some embodiments.

According to some embodiments, the cable 150 coupling the first computing device 110 and the second computing device 120 is formed as a waveguide cable adapted to transmit digital information in the form of electromagnetic waves. For example, FIG. 3 is cross-sectional view of a waveguide cable 300 according to some embodiments. The waveguide cable 300 includes a dielectric core 310, such as a low loss dielectric core 310 that extends the length of the cable 300. The dielectric core 310 might be formed of, for example, TEFLON® brand polytetrafluoroethylene (available from DuPont), polyurethane, air, or another appropriate material. According to some embodiments, the dielectric core 310 may have a substantially circular cross-section.

According to some embodiments, a conducting layer 320 surrounds the dielectric core 310 (e.g., and may also extend along the length of the cable 300). The conducting layer might comprise, for example, a copper wire braid. An insulating layer 330 may surround the conducting layer 320 according to some embodiments (e.g., a sheath of rubber or plastic may extend along the length of the cable 300). Note that materials used for the dielectric core 310, the conducting layer 320, and/or the insulating layer 330 may be selected, according to some embodiments, such that the waveguide cable 300 is sufficiently flexible.

Figure 4:
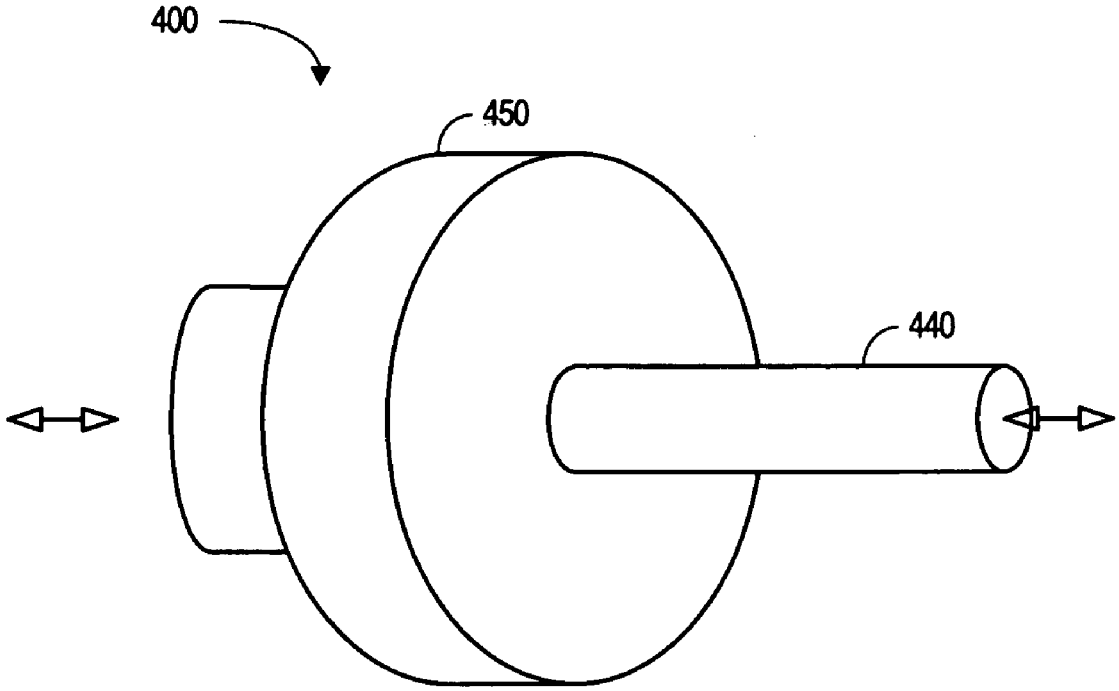
FIG. 4 is an antenna for a waveguide cable according to some embodiments.

FIG. 4 is an antenna 400 that may be associated with a waveguide cable according to some embodiments. For example, one antenna 400 might be mounted at a first end of a cable portion (e.g., to act as a transmitting antenna), and a second antenna may be mounted at the opposite end (e.g., to act as a receiving antenna). The antenna 400 includes a transmitting/receiving portion 440, such as a horizontally polarized antenna, that converts an electrical signal into electromagnetic waves and/or electromagnetic waves into an electrical signal. The antenna 400 may also include a Surface Mounted Assembly (SMA) 450 that may be adapted to interface with a computing device.

Figure 5:
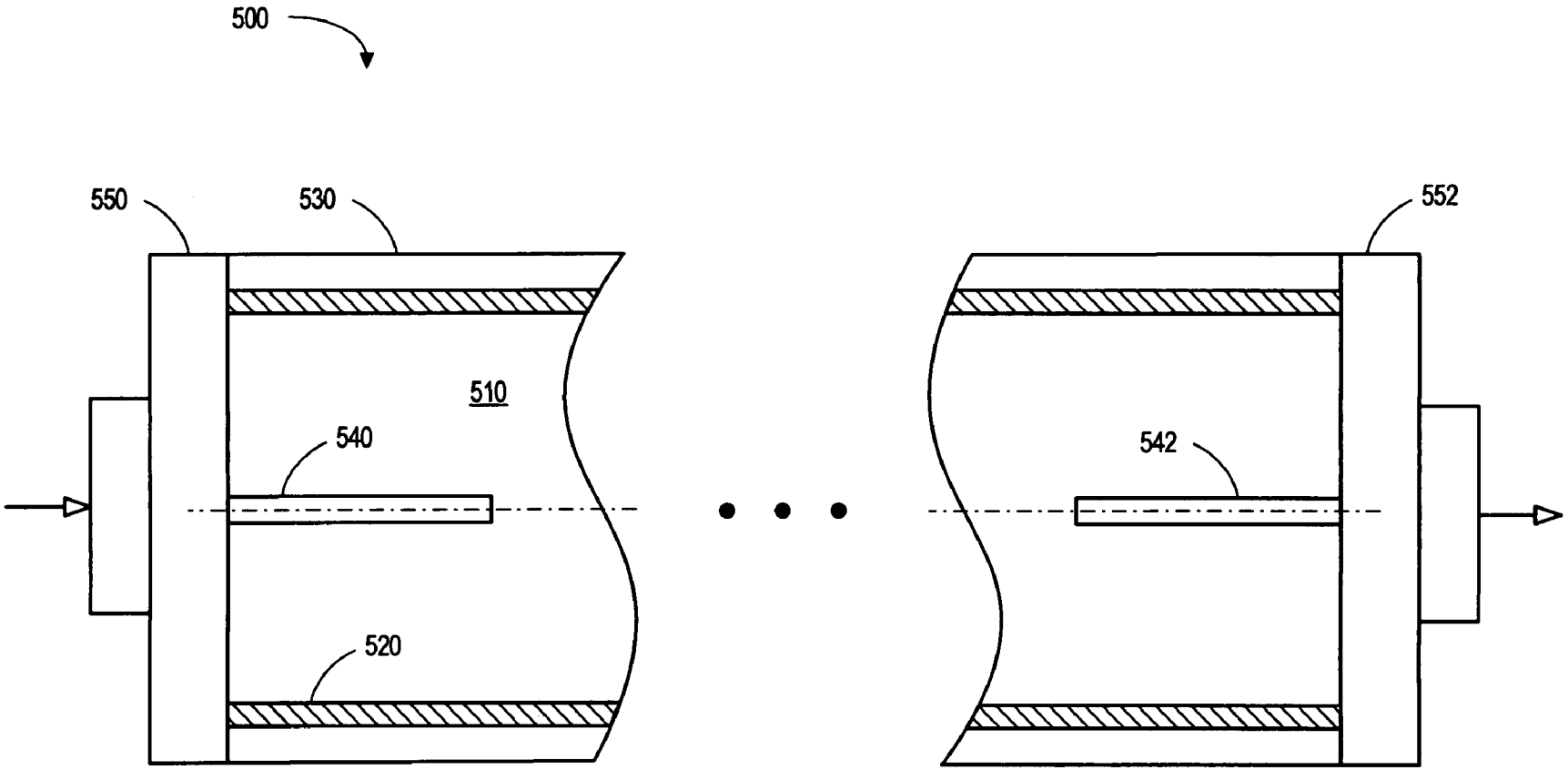
FIG. 5 is a side cross-sectional view of a waveguide cable according to some embodiments.

FIG. 5 is a side cross-sectional view of a waveguide cable 500 according to some embodiments. The cable 500 may include a flexible cable portion having an axis that extends along it's length, including: a dielectric medium 510, a copper wire braid layer 520 that surrounds the dielectric medium 510, and an insulating layer 530 that surrounds the copper wire braid layer 520.

A transmitting portion 540 of a first antenna 550 may extend into the dielectric medium 510 at one end of the cable 500. Similarly, a receiving portion 542 of a second antenna 552 may extend into the dielectric medium 510 at the opposite end of the cable 500. The transmitting and receiving portions 540, 542 may comprise, for example, horizontally polarized antennas that extend along the axis of the cable. The transmitting portion 540 may be adapted to, for example, receive a digital signal (e.g., from a first computing device) and to propagate energy through the dielectric medium 510. The receiving portion 542 may be adapted to, for example, receive energy and to provide a digital signal (e.g., to a second computing device). According to some embodiments, other antenna arrangements may be provided. For example, vertically polarized antennae might be used to transmit and receive energy.

Figure 6:
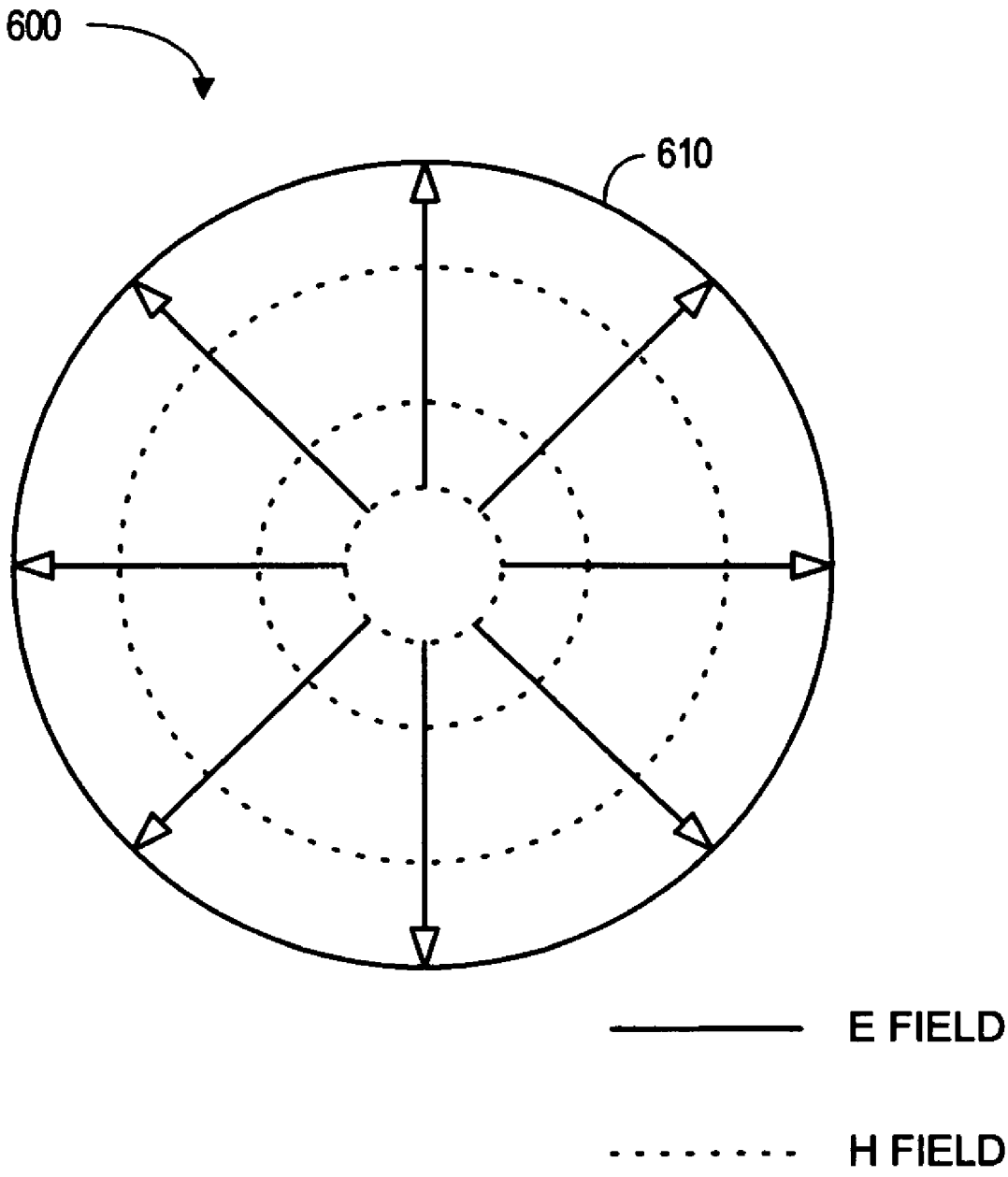
FIG. 6 illustrates energy propagation through a waveguide cable according to some embodiments.

The materials and dimensions of the waveguide cable may be selected such that the electromagnetic wave will appropriately propagate from the transmitting portion 540 to the receiving portion 542. That is, the materials may act as a hollow, flexible pipe or tube through which the electromagnetic waves will flow. For example, FIG. 6 illustrates energy propagation 600 through a waveguide cable according to some embodiments. In this case, a dielectric medium 610 has a substantially circular cross-section, and the energy (e.g., the electric E-field and magnetic H-field) is excited in a low order radial mode. The energy might propagate, for example, in the lowest order radial mode TM01.

Figure 7:
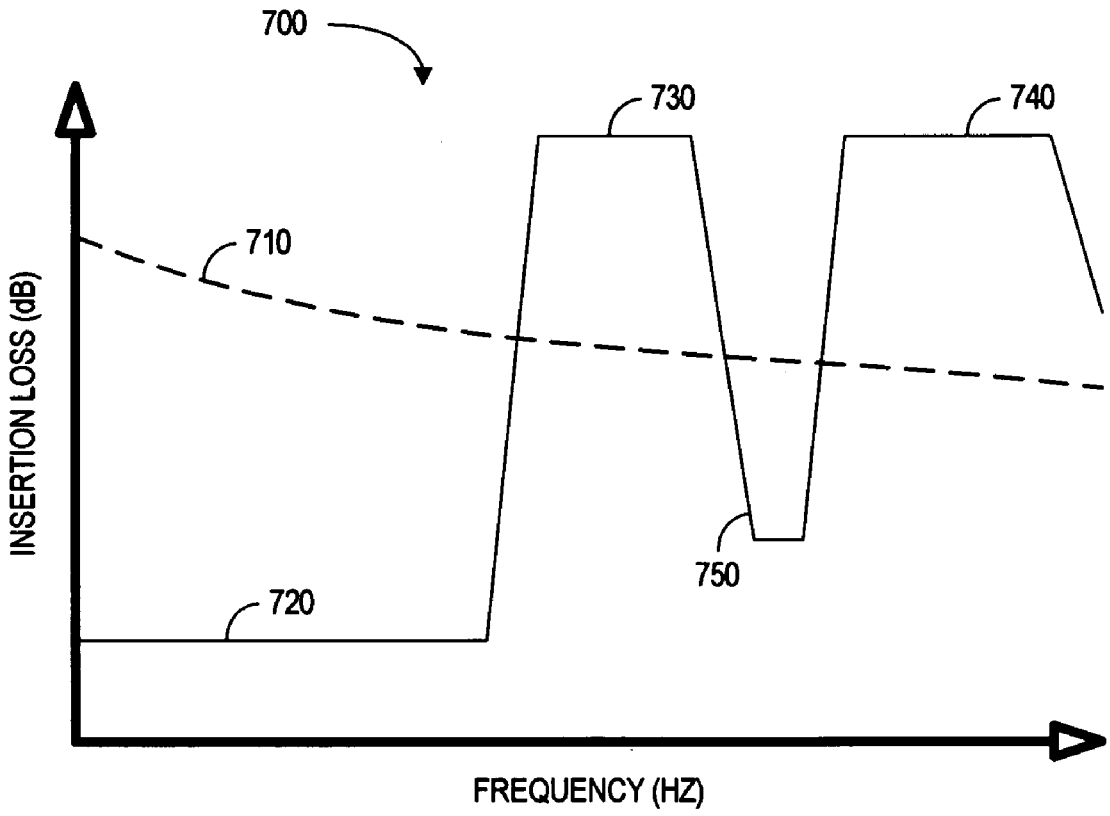
FIG. 7 is a chart illustrating insertion loss as a function of frequency according to some embodiments.

Because electromagnetic waves are used to transmit the digital information, a waveguide cable may be associated with at least one relatively high frequency pass-band region. For example, FIG. 7 is a chart 700 illustrating insertion loss as a function of frequency according to some embodiments. As with FIG. 2, FIG. 7 also shows an x-axis which represents the frequency at which digital information is transmitted in Hz (with movement along the x-axis to the right representing an increase in the rate), and a y-axis which represents the insertion loss in decibels (dB) (with movement along the y-axis upwards representing an decrease in the loss, and therefore an increase in the strength of the signal). Note that the chart 700 includes a plot 710 associated with a normal electrical cable (illustrated by a dashed line in FIG. 7) for comparison.

As can be seen by plot 720, the waveguide filter is associated with two high frequency pass-band regions 730, 740. Note that the region 750 between the two high frequency pass-band regions 730, 740 might be caused by, for example, interference from another mode. According to some embodiments, a multi-band modulated carrier may be used to transmit digital information using the frequencies of the pass-band regions 730, 740. Note that as the diameter of a dielectric core becomes smaller, the frequencies associated with the pass-band regions may increase. According to some embodiments, a waveguide cable having dimensions similar to those of an RG6 coaxial cable may have a pass-band region associated with approximately 30 to 40 GHz. Also note that the frequency response in these regions 720, 730 may reduce ISI problems as compared to a typical electrical cable (e.g., the need for equalization may be reduced). As a result, digital information may be transmitted between computing devices, through a waveguide cable, at relatively high rates. Moreover, the use of expensive and sensitive optical components may be avoided.

Figure 8:
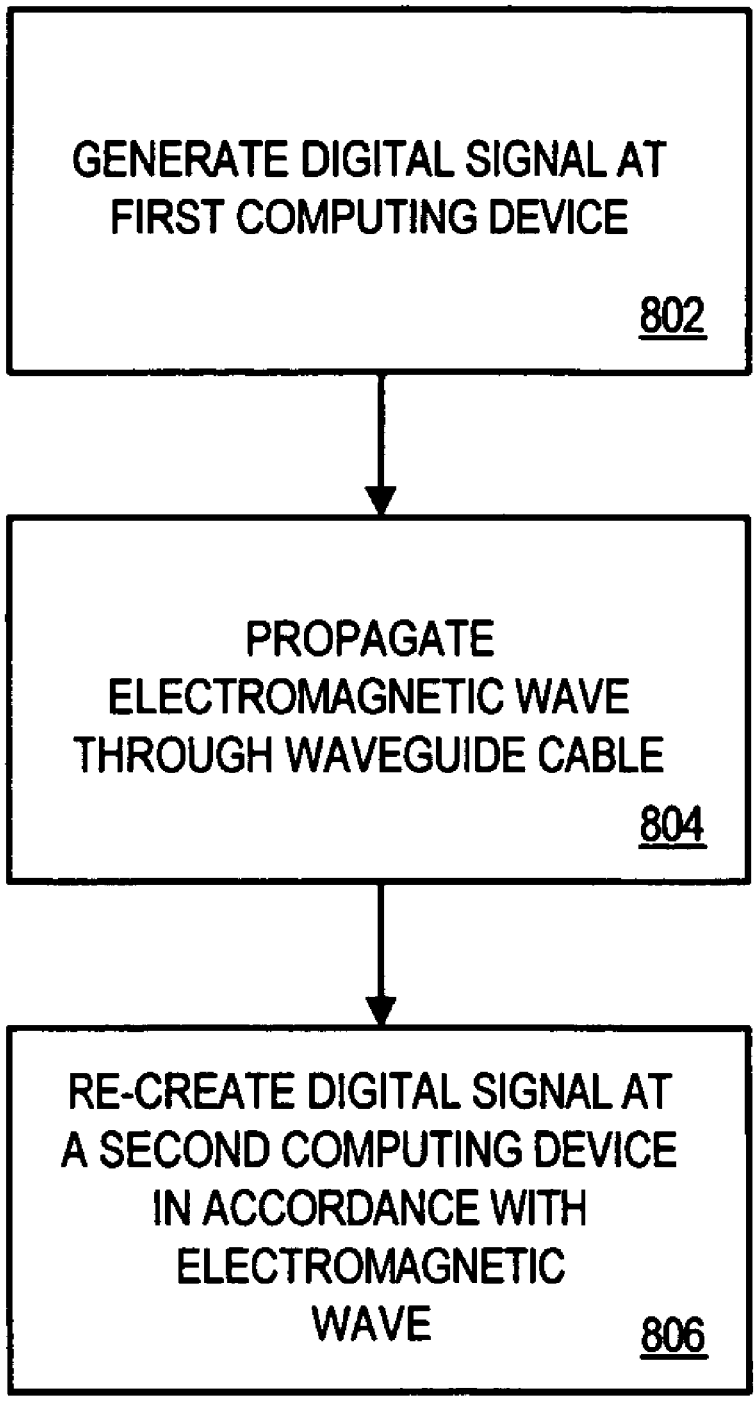
FIG. 8 is a flow diagram of a method according to some embodiments.

FIG. 8 is a flow diagram of a method according to some embodiments. At 802, a digital signal is generated at a first computing device (e.g., an electrical signal may be generated having a relatively high data rate). At 804, an electromagnetic wave associated with the digital signal propagates through a waveguide cable (e.g., via a transmitting antenna at one end of the cable). The digital signal is then re-created at a second computing device in accordance with the electromagnetic wave at 806 (e.g., by a receiving antenna at the opposite end of the cable). In this way, the first and second computing devices may exchange information.

The following illustrates various additional embodiments. These do not constitute a definition of all possible embodiments, and those skilled in the art will understand that many other embodiments are possible. Further, although the following embodiments are briefly described for clarity, those skilled in the art will understand how to make any changes, if necessary, to the above description to accommodate these and other embodiments and applications.

Figure 9:
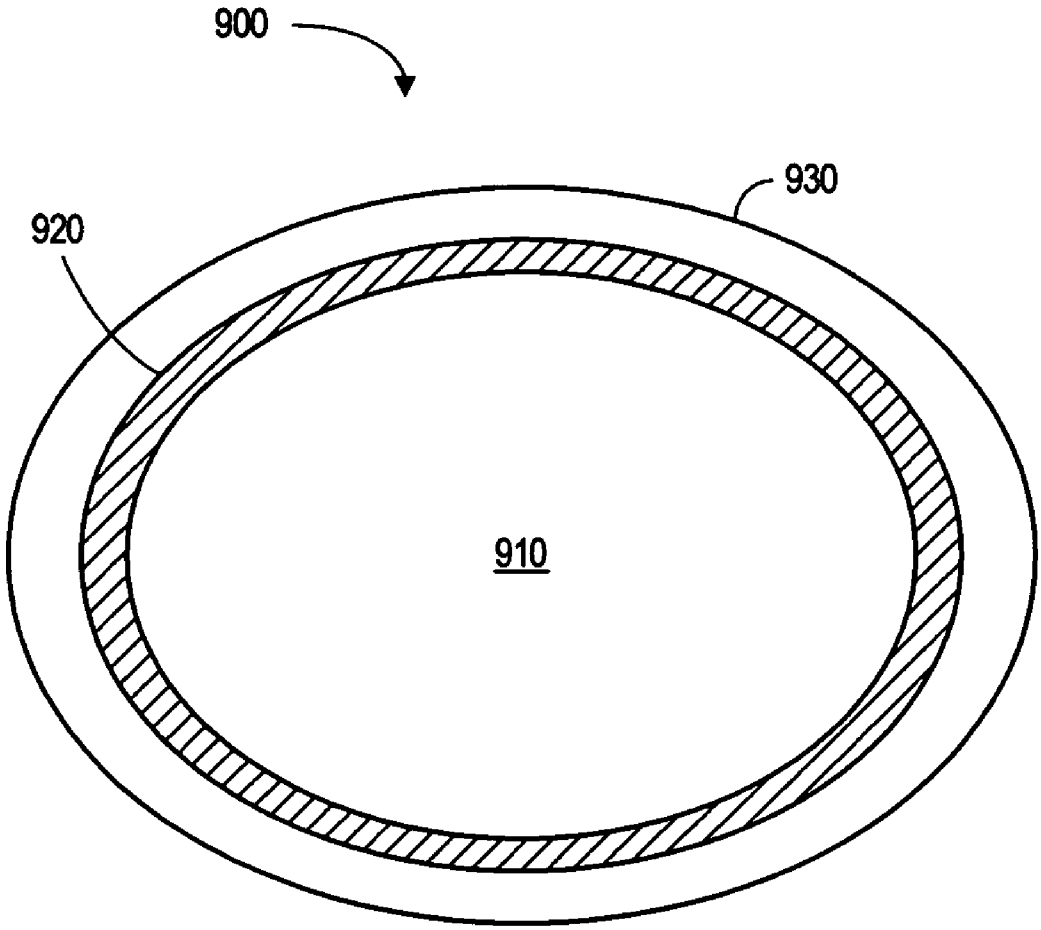
FIG. 9 is a cross-sectional view of a waveguide cable according to another embodiment.

For example, although dielectric cores with substantially circular cross-sections have been described, note that dielectric core may have other shapes in accordance with any of the embodiments described herein. For example, FIG. 9 is a cross-sectional view of a waveguide cable 900 according to another embodiment. In this case, a dielectric core 910 having an elliptical or oval cross section may be provided. As a result, a conducting layer 920 and/or an insulating layer 930 may also have an elliptical or oval shape. Similarly, dielectric cores having any other shape may be provided.

Moreover, some embodiments herein have described a transmitting or receiving antenna as being part of a waveguide cable. Note that a waveguide cable might not include any antenna. In this case, a transmitting antenna might be formed as part of a first computing device, and a receiving antenna might be formed as part of a second computing device.

The several embodiments described herein are solely for the purpose of illustration. Persons skilled in the art will recognize from this description other embodiments may be practiced with modifications and alterations limited only by the claims.

What is claimed is:

1. An apparatus, comprising:

a flexible cable portion associated with an axis extending the length of the flexible cable portion, including:

a polyurethane dielectric medium extending the length of the flexible cable portion, a copper wire braid layer extending the length of the flexible cable portion and surrounding the dielectric medium, and an insulating layer extending the length of the cable portion and surrounding the copper wire braid layer;

a first horizontally polarized antenna extending along the axis, at a first end of the flexible cable portion, to receive a digital signal and to propagate energy through the flexible cable portion; and a second horizontally polarized antenna extending along the axis, at a second end of the flexible cable portion opposite the first end, to receive the energy from the flexible cable portion and to provide the digital signal.

2. The apparatus of claim 1, wherein the energy propagates through the dielectric medium as an electromagnetic wave.

3. The apparatus of claim 1, wherein the dielectric medium has a substantially circular cross-section and the energy propagates in a low order radial mode.

4. An apparatus, comprising:

a cable portion, including:

a dielectric core extending the length of the cable portion, and a conducting layer extending the length of the cable portion and surrounding the dielectric core;

a first antenna, at a first end of the cable portion, to receive a digital signal and to propagate an electromagnetic wave through the dielectric core; and a second antenna, at a second end of the cable portion opposite the first end, to receive the electromagnetic wave from the dielectric core and to provide the digital signal, wherein the conducting layer comprises a copper wire braid.

5. An apparatus, comprising:

a cable portion, including:

a dielectric core extending the length of the cable portion, and a conducting layer extending the length of the cable portion and surrounding the dielectric core;

a first antenna, at a first end of the cable portion, to receive a digital signal and to propagate an electromagnetic wave through the dielectric core;

a second antenna, at a second end of the cable portion opposite the first end, to receive the electromagnetic wave from the dielectric core and to provide the digital signal; and an insulating layer extending the length of the cable portion and surrounding the conducting layer.

6. The apparatus of claim 5, wherein the dielectric core has a substantially circular cross-section.

7. The apparatus of claim 5, wherein dimensions of the dielectric core, the first antenna, and the second antenna result in low order radial mode propagation of the electromagnetic wave.

8. The apparatus of claim 7, wherein the low order radial mode comprises TM01.

9. The apparatus of claim 5, wherein at least one of the first and second antennas is associated with a surface mounted assembly.

10. The apparatus of claim 5, wherein the cable portion is associated with at least one relatively high frequency passband region.

* * * * *